US006638200B2

(12) United States Patent
Chang

(10) Patent No.: US 6,638,200 B2
(45) Date of Patent: Oct. 28, 2003

(54) JOGGING MACHINE

(76) Inventor: Mark Chang, 7F-7, No. 400, Huan Pei Rd., Chung Li City, Tao Yuan Hsien (TW)

( * ) Notice: Subject to any disclaimer, the term of this patent is extended or adjusted under 35 U.S.C. 154(b) by 14 days.

(21) Appl. No.: 09/865,558

(22) Filed: May 29, 2001

(65) Prior Publication Data

US 2002/0183169 A1 Dec. 5, 2002

(51) Int. Cl.[7] ..... A63B 22/02
(52) U.S. Cl. ..... 482/54
(58) Field of Search ..... 482/54

(56) References Cited

U.S. PATENT DOCUMENTS 6,273,842 B1 * 8/2001 Wang et al. ..... 482/54
6,273,843 B1 * 8/2001 Lo ..... 482/54
6,325,745 B1 * 12/2001 Yu ..... 482/54
6,398,696 B1 * 6/2002 Tsou ..... 482/54

* cited by examiner

*Primary Examiner*—Stephen R. Crow
(74) *Attorney, Agent, or Firm*—Browdy and Neimark, P.L.L.C.

(57) ABSTRACT

A jogging machine comprises a base, a jogging platform, a linear actuator mounted on the jogging platform, an urging frame disposed between the base and the jogging platform, and at least one pull rod. The linear actuator actuates the urging frame to urge the jogging platform to change its inclination. The jogging platform is capable of being folded along a fixed path due to the linking of the urging frame and the pull rod.

6 Claims, 11 Drawing Sheets

JOGGING MACHINE

FIELD OF THE INVENTION

The present invention relates generally to an exercise machine, and more particularly to a jogging machine comprising a jogging platform adjustable in elevation angle thereof to facilitate the folding of the jogging platform.

BACKGROUND OF THE INVENTION

The jogging platform of the conventional jogging machine is pivoted at the front end thereof between two upright supports of the base of the jogging machine. The jogging platform is provided in the underside of the rear end with two support legs adjustable manually in length. The rear end of the jogging platform is rested on the ground surface by means of the two support legs. The inclination of the jogging platform is adjusted by adjusting the length of the two support legs, so as to enable the user of the jogging machine to attain various exercise effects.

In order to enhance the convenience of using the jogging machine, certain jogging machine makers have developed a jogging machine comprising a jogging platform adjustable in inclination by means of an electrically-powered connection rod mechanism, as shown in FIG. 1. The jogging machine 2 is characterized by its jogging platform 70 which is pivoted with a linking frame 80 formed of two connection rods 81, a displacement rod 82, a reinforcing rod 83, and two slide wheels 84. The base 90 of the jogging platform 70 is provided with two slide rails 71 for accommodating the two slide wheels 84. The base 90 is provided with an electric actuation device A for connecting the displacement rod 82 to drive the linking frame 80 to urge the jogging platform 70 to rise. Two elevation rods B are disposed between the base 90 and the jogging platform 70. The inclination of the jogging platform 70 is adjusted by the actuation device A, the linking frame 80 in conjunction with the two elevation rods B. In addition, the jogging platform 70 can be folded.

According to the test done by this inventor of the present invention, this prior art jogging machine has the following drawbacks.

The electric actuation device A of the jogging machine 2 is mounted on the base 90 such that the actuation device A is located between the base 90 and the jogging platform 70, thereby taking up a great deal of space of the base 90 to accommodate the jogging platform 70. In addition, the bottom space of the jogging platform 70 is also reduced to limit the inclination adjustment of the jogging platform 70. In other words, the downward space of the jogging platform 70 is limited.

In light of the actuation device A of the jogging machine 2 taking up the bottom space of the jogging platform 70, the folding of the jogging platform 70 is apt to be interfered by the actuation device A. As a result, before the jogging platform 70 is folded, the actuation device A must be first started to raise the jogging platform 70 so as to facilitate the folding of the jogging platform 70.

When the jogging platform 70 is being folded, the jogging platform 70 is swiveled upwards on the pivoting center of the two linking rods 81 to arrive at a predetermined position at which the jogging platform 70 is fixed by a fastening member that is mounted on a predetermined location of the base 90. In the midst of the folding action, the position of the pivoting center of the jogging platform 70 is a factor determining the success of alignment of the jogging platform 70 with the fastening member. If the position of the pivoting center is excessively high, low, forward, or rearward, the jogging platform 70 will not be in alignment with the fastening member in the wake of the upward swiveling motion of the jogging platform 70. As a result, the jogging platform 70 can not be securely located by the fastening member. As a result, before the jogging platform 70 is folded, the actuation device A must be started to raise the jogging platform 70 to a fixed position, so as to enable the jogging platform 70 to be in alignment with the fastening member upon the completion of folding the jogging platform 70. It is therefore readily apparent that the folding process of the jogging platform 70 of the prior art jogging machine 2 is rather complicated and burdensome.

The shortcomings of the prior art jogging machine 2 are due to the improper mechanical design and component disposition. For example, the actuation device A must be disposed on the base 90 due to the way by which the linking frame 80 and the two elevation rods B are disposed. In addition, the linking frame 80 is driven by the actuation device A from the underside of the jogging platform 70. In light of the underside space of the jogging platform 70 being taken up, the inclination adjustment of the jogging platform 70 is thus obstructed. The folding process of the jogging platform 70 is also obstructed. The jogging platform 70 is pivoted with the linking frame 80 and the two elevation rods B in a simple manner, thereby causing the stop position of the jogging machine 2 to be easily affected by the pivoting position of the jogging platform 70 and the two linking rods 81 upon the completion of the folding of the jogging machine 2. In other words, the jogging platform 70 can not be folded according to a fixed path because of the defective connection design of the jogging platform 70, the linking frame 80, and the two elevation rods B.

SUMMARY OF THE INVENTION

The primary objective of the present invention is to provide a jogging machine with a jogging platform which is electrically adjusted in its inclination and is immune from the interference of an actuation device of the jogging machine. The jogging platform is provided with a fixed path in which the jogging platform is folded and located.

The foregoing objective of the present invention is attained by a jogging machine comprising a base, a jogging platform, an urging frame, a linear actuator, and at least one pull rod.

The base is rested on the ground surface and is provided with two guide slots symmetrical to each other. The urging frame has a main support rod and an auxiliary support rod parallel to the main support rod, two side support rods connecting the main support rod and the auxiliary support rod, an input member mounted on the main support rod, and two rollers mounted on two side ends of the auxiliary support rod. The urging frame is pivotally mounted on the jogging platform such that the urging frame swivels on the axis of the main support rod, and that the two rollers are slidably located in the two guide slots to slide therein back and forth. The linear actuator is mounted on the jogging platform and is connected with the input member of the urging frame for actuating the input member, so as to enable the urging frame to swivel. The pull rod is pivoted at both ends with the main support rod and the base.

DETAILED DESCRIPTION OF THE INVENTION

Figure 1:
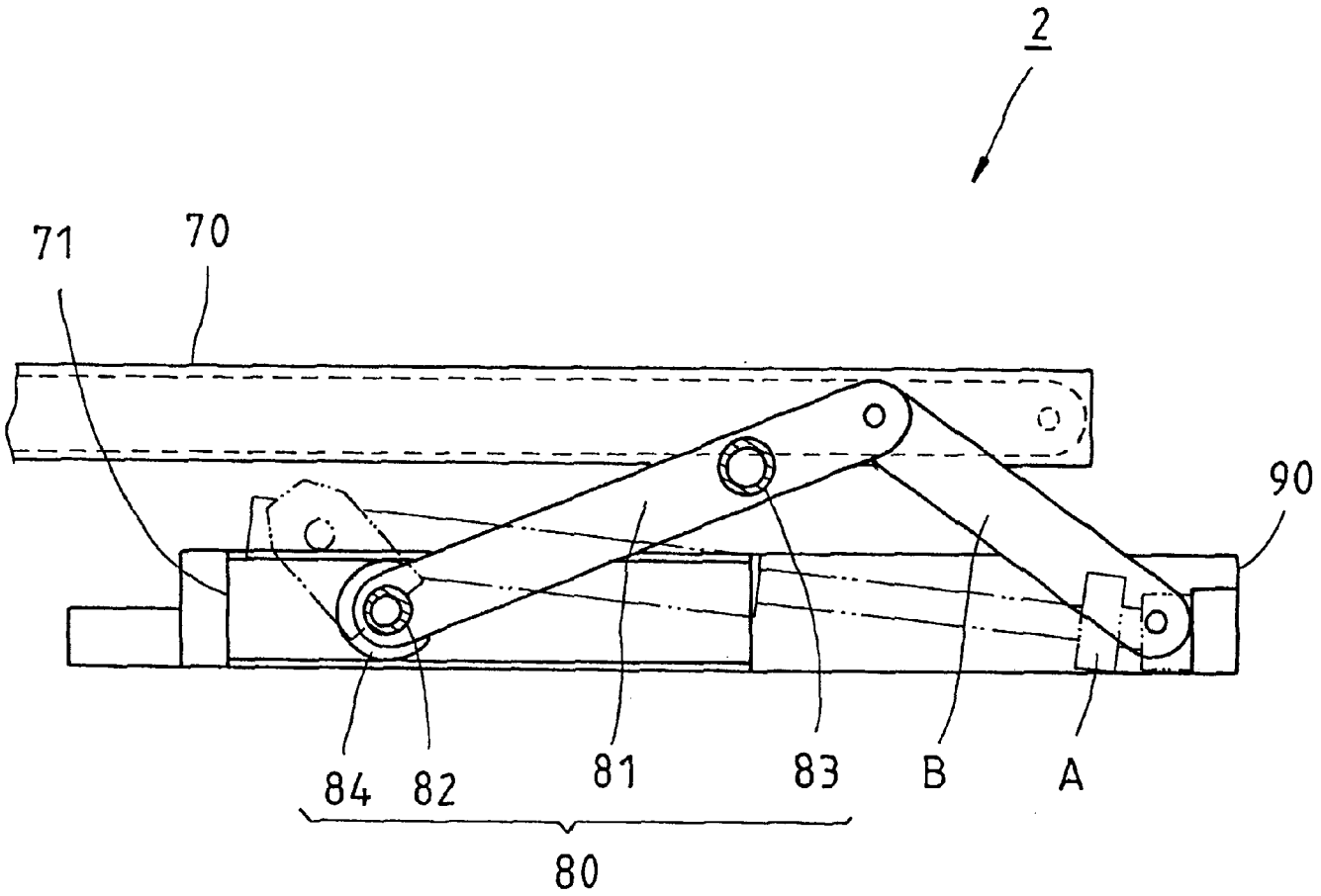
FIG. 1 PRIOR ART
FIG. 1 shows a conventional folding jogging machine.
Figure 2:
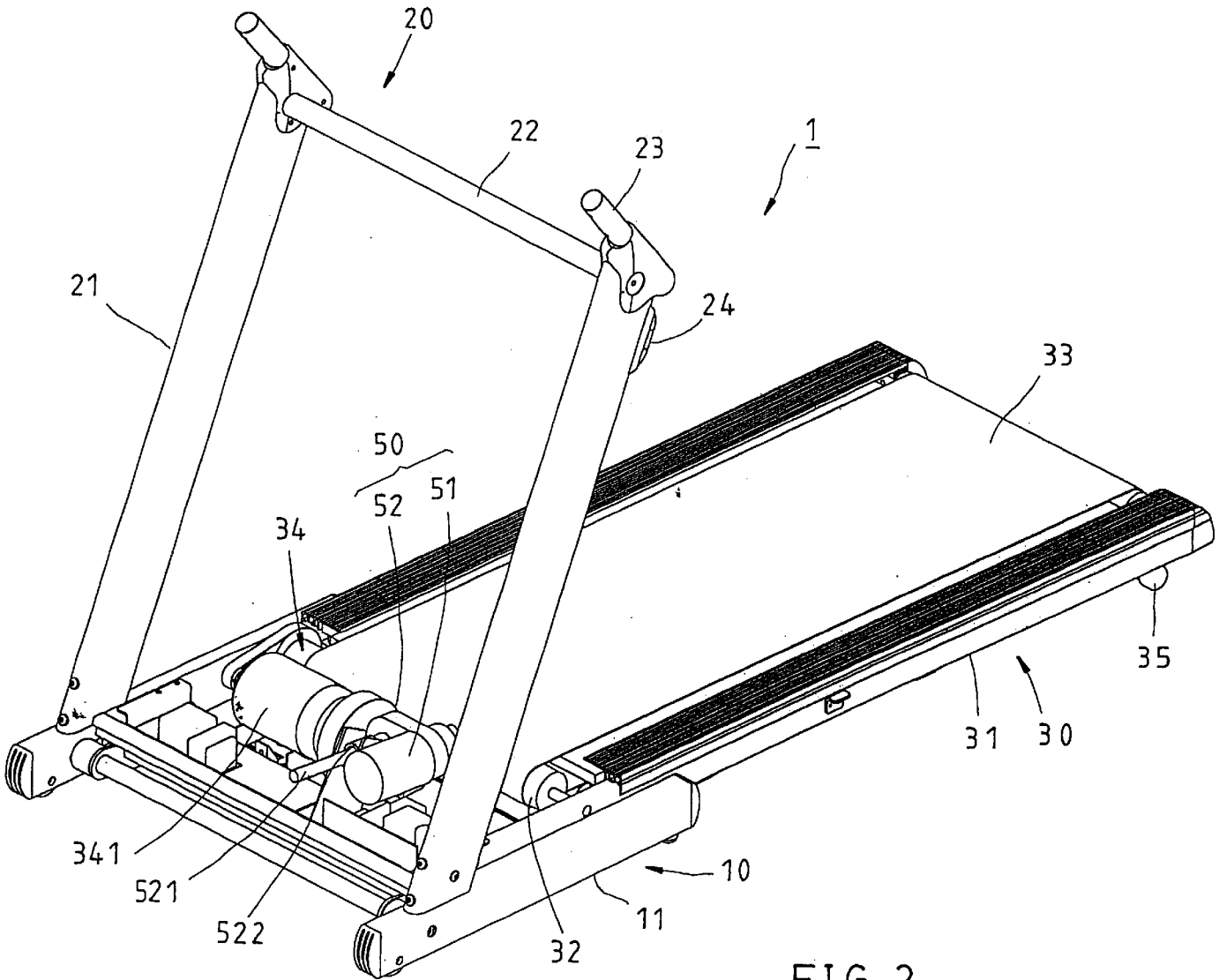
FIG. 2 shows a perspective view of a preferred embodiment of the present invention.
Figure 3:
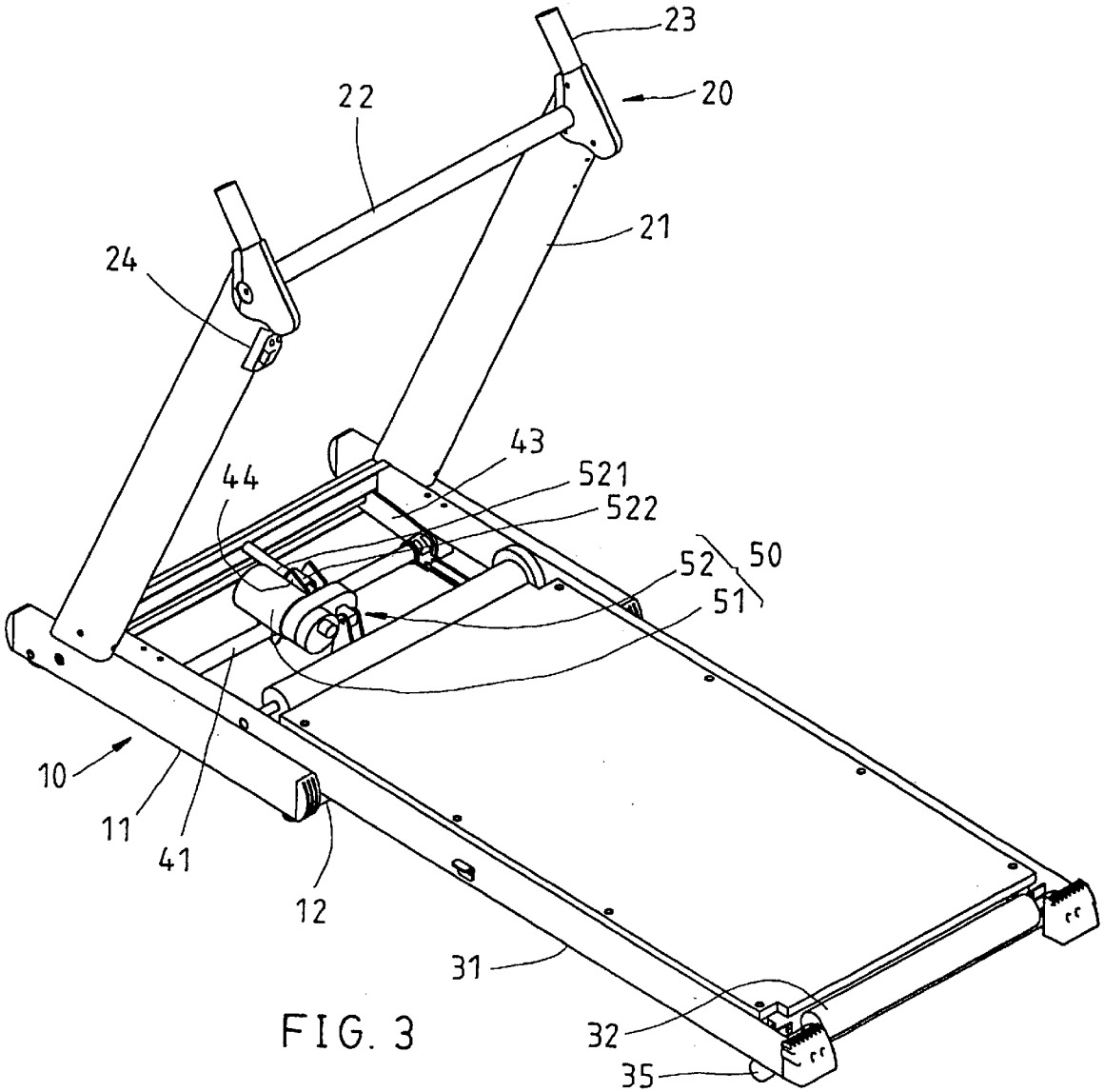
FIG. 3 shows a perspective view of the preferred embodiment as shown in FIG. 2 after the removal of some components.

As shown in FIGS. 2–6, a jogging machine 1 of the preferred embodiment of the present invention comprises the following component parts.

A base 10 has two parallel base rods 11 and two connection rods 12 for use in connecting respectively the front ends and the rear ends of the two base rods 11. The two base rods 11 are provided in the inner wall of the front segment thereof with a guide slot 111. The two guide slots 111 are symmetrical to each other.

A handrail frame 20 has two parallel support rods 21 mounted respectively on the top of the front segment of the two base rods 11 of the base 10; a cross rod 22 connecting the two support rods 21; two hand grips 23 fastened respectively to the top ends of the two support rods 21; and a fastening lock 24 mounted on the support rod 21.

A jogging platform 30 has two parallel side rods 31 between which two rollers 32 are disposed; a jogging belt 33 running through the two rollers 32; and one set of drive device 34 having an electric motor 341 to drive the rollers 32.

An urging frame 40 has a main support rod 41, an auxiliary support rod 42 parallel to the main support rod 41, two side support rods 43 connecting two sides of the main support rod 41 and the auxiliary support rod 42, an input member 44 mounted securely on the main support rod 41, and two rollers 45 mounted on two ends of the auxiliary support rod 42. The two ends of the main support rod 41 are pivoted with the pivoting seats of the underside of the side rod 31 of the jogging platform 30, thereby enabling the urging frame 40 to swivel on the axis of the main support rod 41. The rollers 45 of the urging frame 40 are slidably disposed in the two guide slots 111 to slide back and forth.

A linear actuator 50 is formed of a motor 51, and a speed changing output member 52 which has a transmission shaft 521 and a driven member 522 fitted over the transmission shaft 521. The transmission shaft 521 is a guide threaded rod. The driven member 522 is a threaded sleeve. When the transmission shaft 521 turns, the driven member 522 is caused to move along the axial direction of the transmission shaft 521 by limiting the rotating of the driven member 522. The linear actuator 50 is mounted on the jogging platform 30. The driven member 522 is pivoted with the input member 44 of the urging frame 40.

Two pull rods 60 are pivoted at two ends with the inner wall of the rear segment of the two base rods 11 and two ends of the main support rod 41. The pull rods 60 are provided with a caster 61 which is located in proximity of the point at which the pull rods (6) are respectively pivoted to the base rods 11.

The use and the operational principle of the jogging machine 1 are described hereinafter with reference to FIGS. 6–11.

Figure 6:
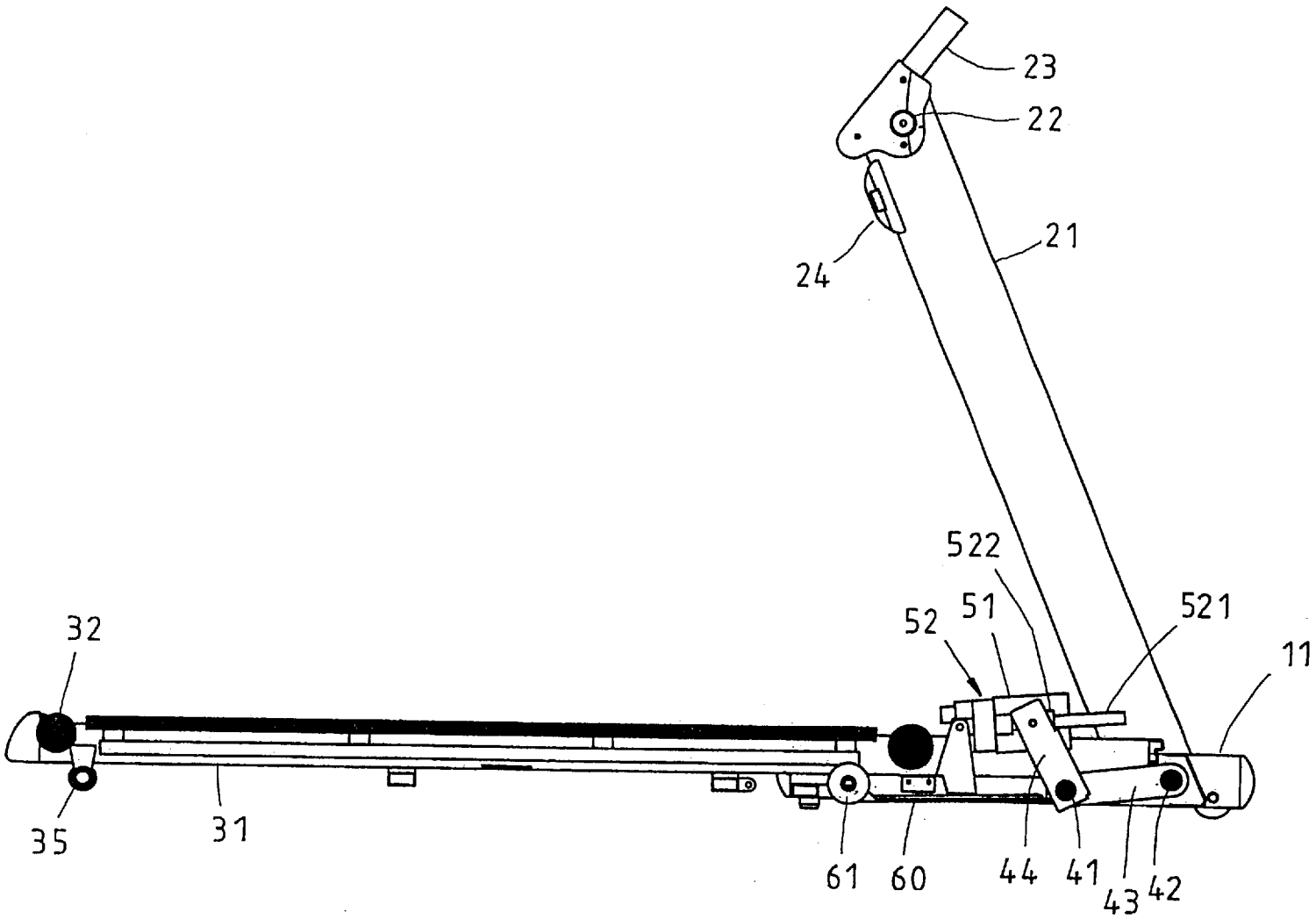
FIG. 6 shows a sectional view taken along the direction indicated by a line 6—6 as shown in FIG. 5.

As shown in FIG. 6, under the state of ordinary use, the jogging platform 30 of the jogging machine 1 is rested on the ground surface by means of two casters 35 which are rotatably engaged to the rear end of the jogging platform 30. The driven member 522 of the linear actuator 50 is located at the base portion of the transmission shaft 521. The urging frame 40 and the two pull rods 60 are almost horizontally disposed between the jogging platform 30 and the base 10. In light of this state, the front segment of the jogging platform 30 is accommodated between the two base rods 11 of the base 10 such that the underside of the midsegment of the two side rods 31 is rested against the rear connection rod 12. The jogging platform 30 is in the horizontal state. The user stands on the jogging belt 33 of the jogging platform and then starts the electric motor 341 to drive the jogging belt 31, so as to enable the user to begin the jogging exercise.

Figure 7:
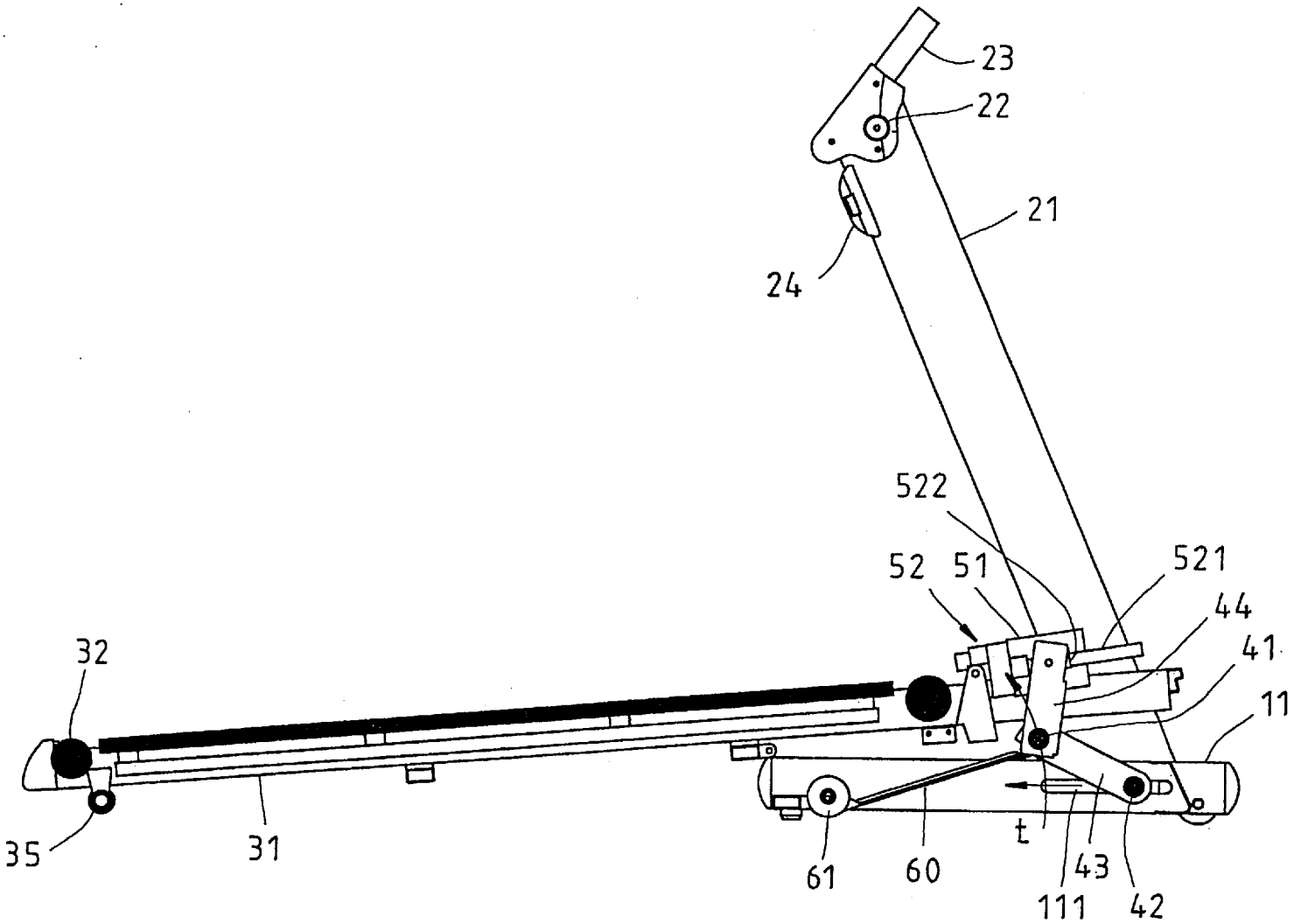
FIGS. 7–8 show respectively what is shown in FIG. 3 in the rising state according to the sectional direction of FIG. 6.
Figure 8:
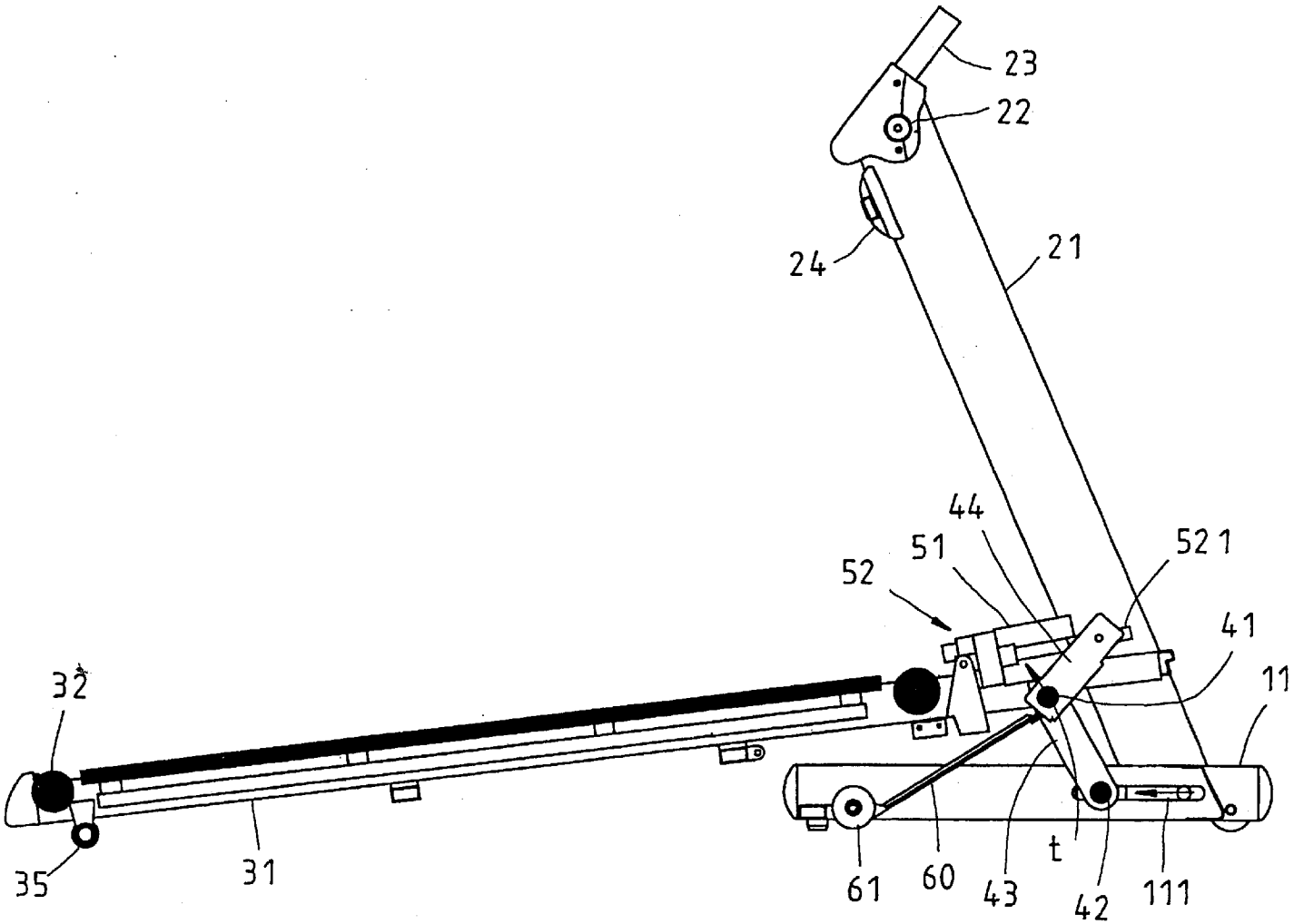
Figure 9:
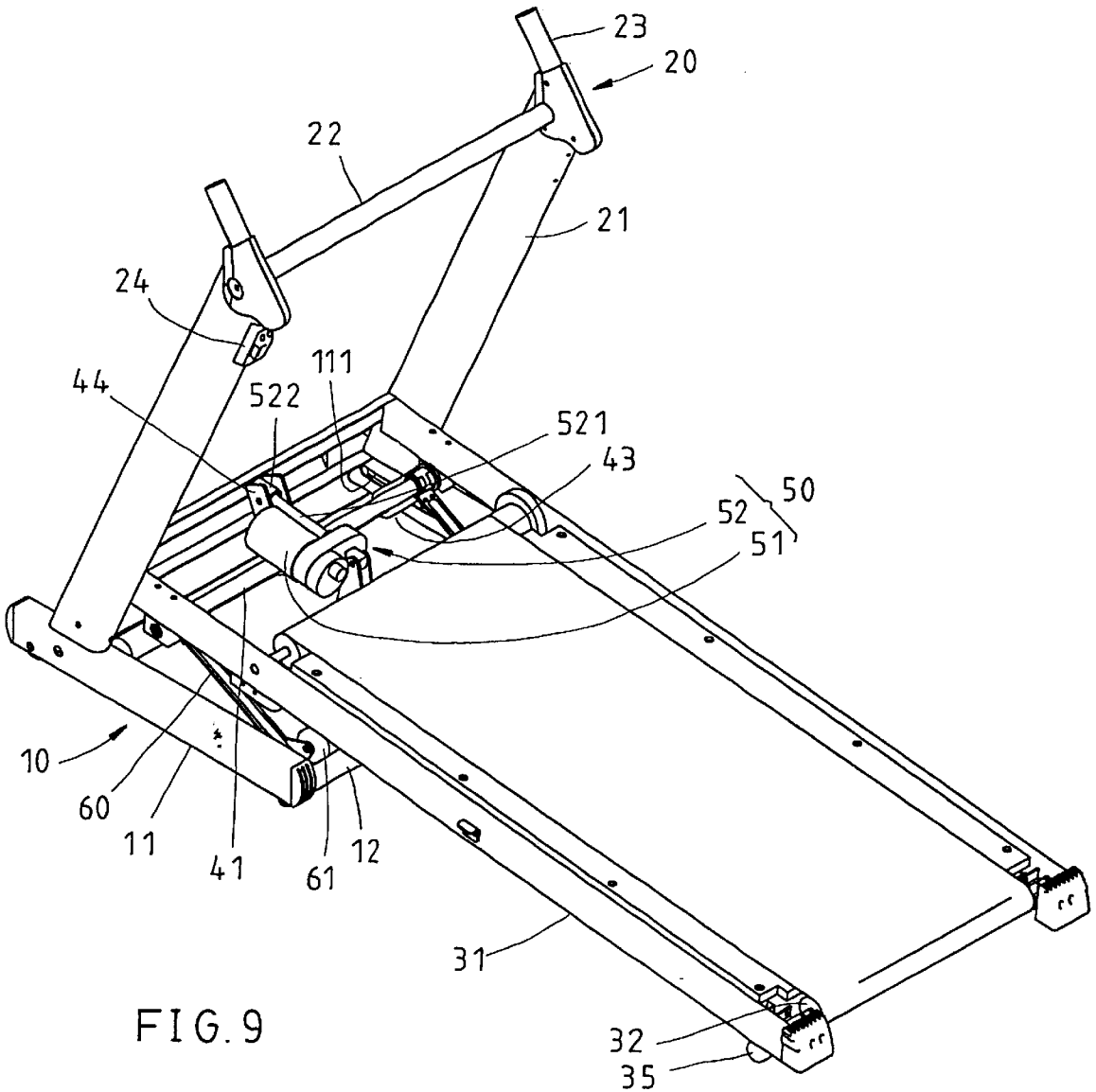
FIG. 9 shows a perspective view of what is shown in FIG. 3 in the state of FIG. 8.

As shown in FIGS. 7–9, the user may raise the jogging platform 30 to be in the state of angle of elevation to enhance the exercise energy by starting the linear actuator 50 as to cause the transmission shaft 521 to turn forward, thereby causing the driven member 522 to move toward the end of the transmission shaft 521. The input member 44 is thus actuated to turn the entire urging frame 40 to swivel downward to enable the rollers 45 to slide toward the rear end of the guide slots 111. By means of the guidance of the two pull rods 60, the urging frame 40 pushes the front segment of the jogging platform 30 to rise. As a result, the jogging platform 30 is so slanted that the user of the machine is required to expend a greater exercise energy, as shown in FIG. 8. The inclination of the jogging platform 30 is controlled by controlling the actuating direction and the actuating range of the linear actuator 50.

Figure 4:
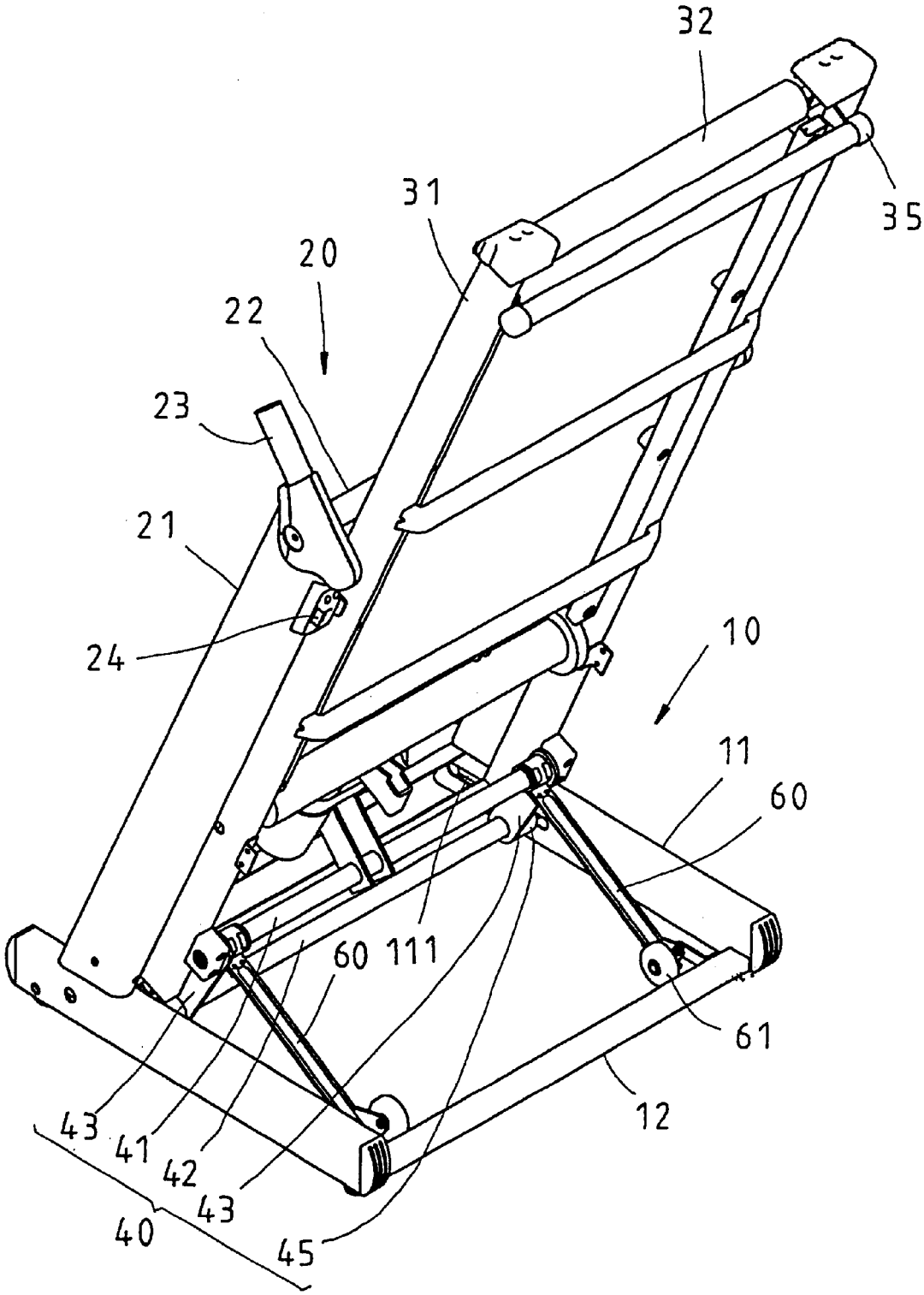
FIG. 4 shows a perspective view of what is shown in FIG. 3 in another state.
Figure 5:
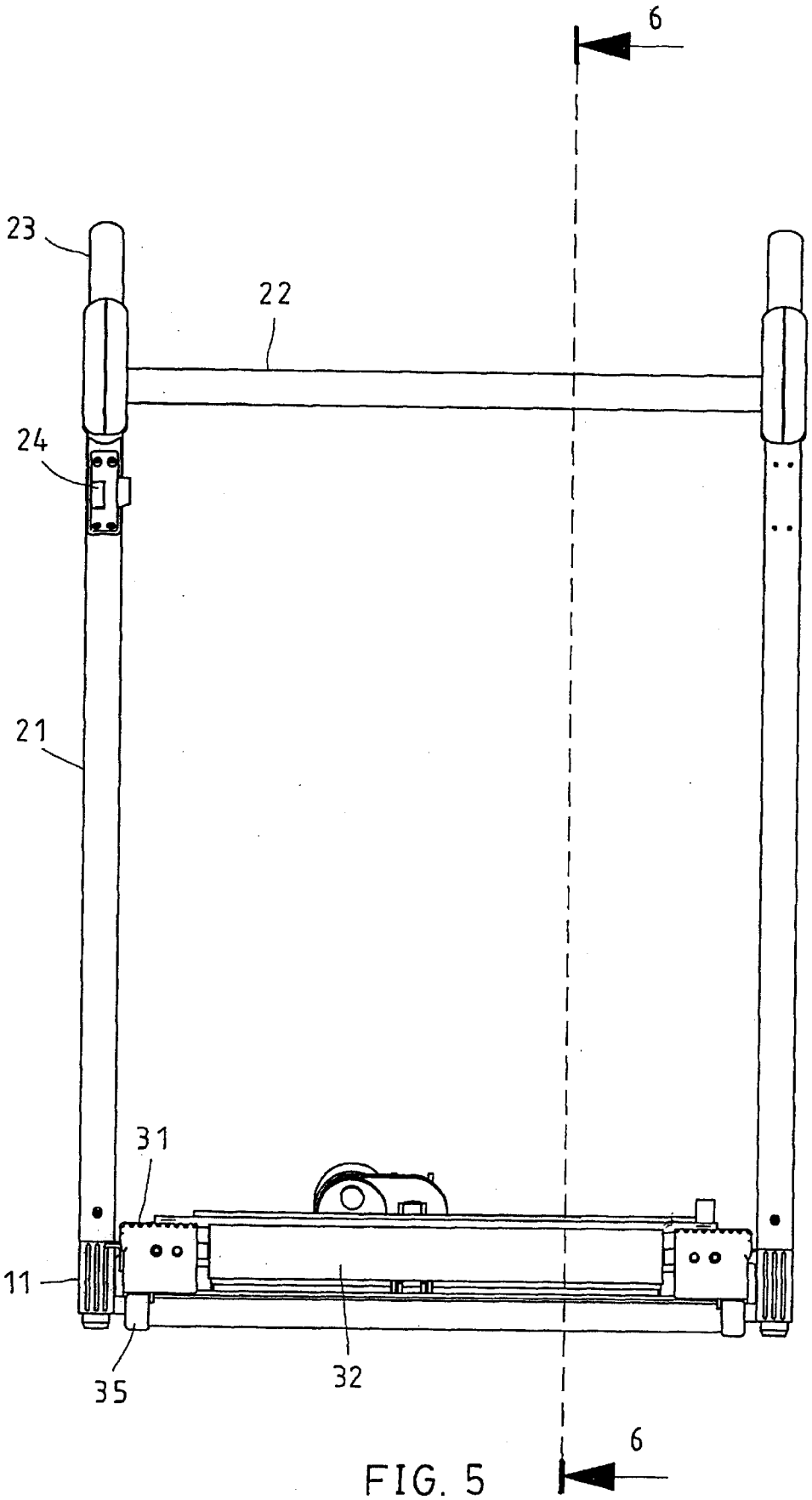
FIG. 5 is a rear view of what is shown in FIG. 3.
Figure 10:
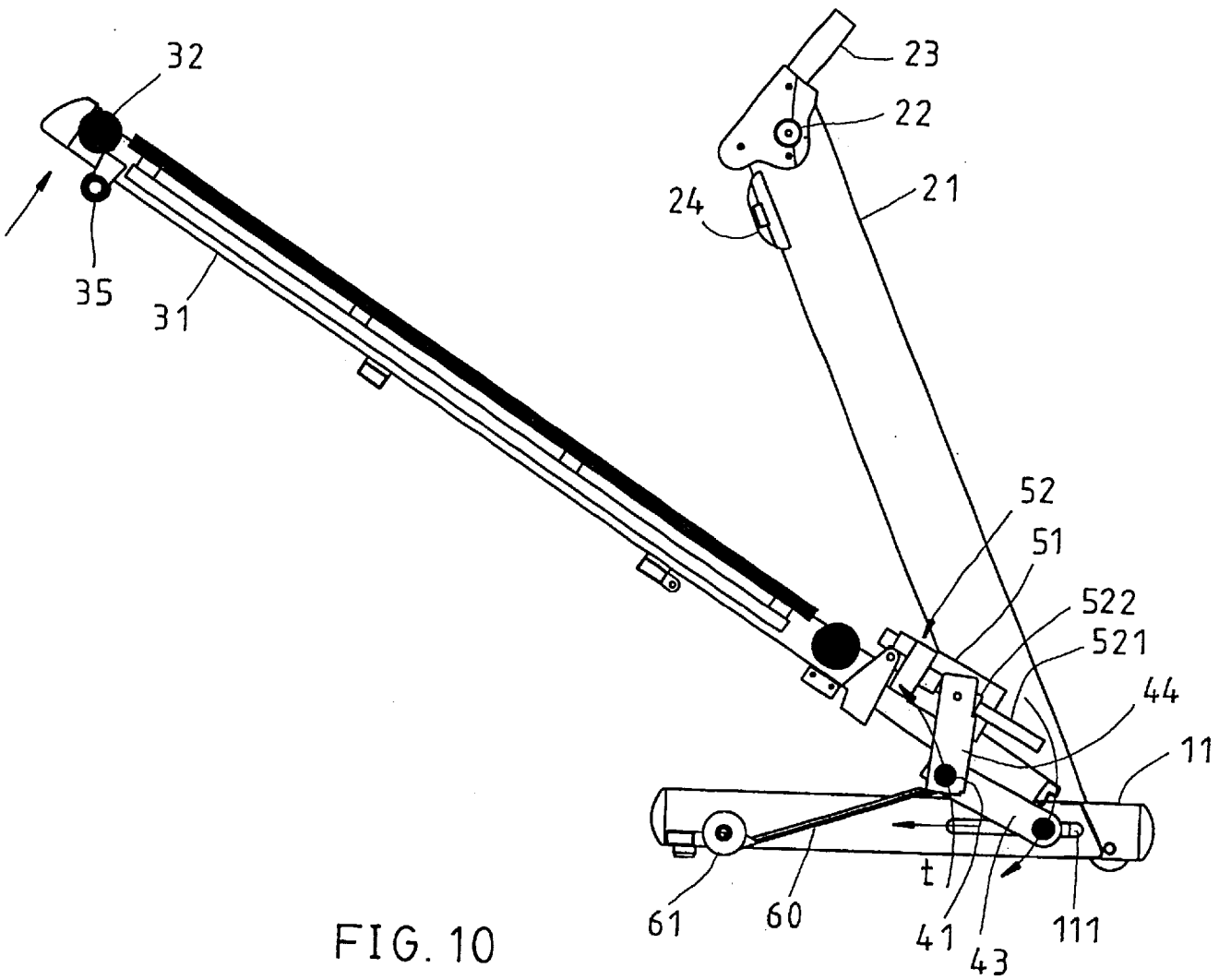
FIGS. 10–11 show respectively what is shown in FIG. 3 in the folding state according to the sectional direction of FIG. 6.
Figure 11:
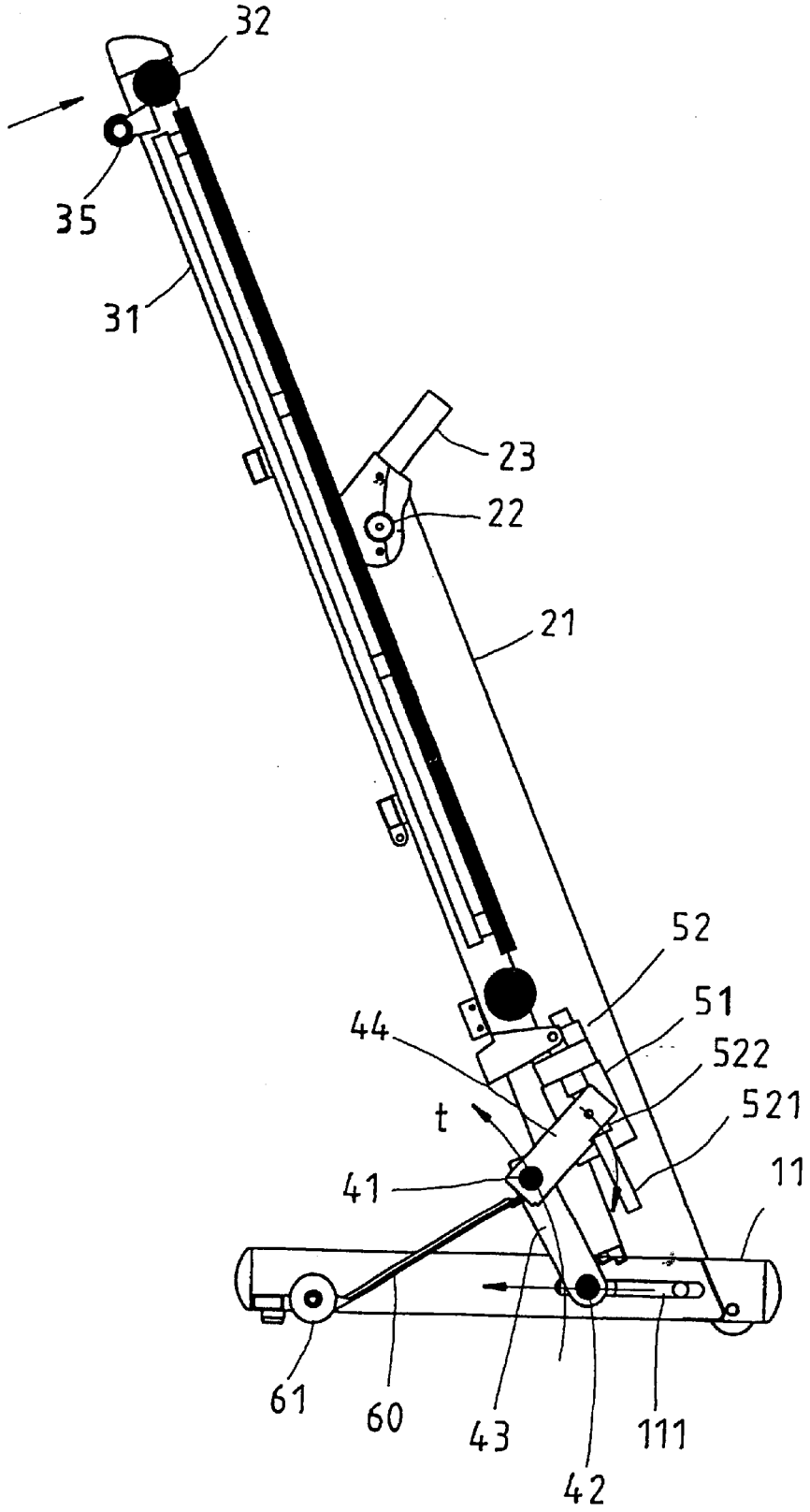

As shown in FIGS. 4, 10 and 11 when the jogging machine 1 is not in use, the rear end of the jogging platform 30 is raised to rest against the handrail frame 20. The jogging platform 30 can be securely located on the handrail frame 20 by the fastening lock 24, thereby reducing the storage space of the jogging machine 1, as shown in FIG. 4. In the midst of folding the jogging platform 30, the linear actuator 50 and the input member 44 of the urging frame 40 are stationary. For this reason, when the rear end of the jogging platform 30 is raised, the input member 44 is forced to actuate the entire urging frame 40 to swivel forward on the pivoting center of the urging frame and the two pull rods 60, thereby enabling the slide wheel of the urging frame 40 to slide toward the rear end of the guide slot 111. The jogging platform 30 is pushed by the urging frame 40 to move upward along the swiveling trackt of the pull rod 60, as shown in FIGS. 10 and 11. It is therefore apparent that the swiveling center of the jogging platform 30 rises along a fixed arcuate path at the time when the jogging platform 30 is being folded. The folding track of the jogging platform 30 is a fixed track.

The jogging machine 1 of the present invention has advantages, which are summarized as follows.

In light of the mechanical pattern and the structural design of the urging frame 40 and the pull rods 60, the linear actuator can be mounted on the jogging platform 30 such that the linear actuator 50 does not take up the bottom space of the jogging platform 30. As a result, the linear actuator 50 does not interfere with the inclination adjusting and the folding of the jogging machine 1.

In light of the linear actuator 50 being mounted on the jogging platform 30, the jogging platform 30 is provided with a greater bottom space which enhances the degree of freedom of the designs of the urging frame 40 and the two pull rods 60.

In light of the folding track of the jogging platform 30 being a fixed track, the jogging platform 30 is moved to rest against the handrail frame 20 along the fixed path such that the jogging platform 30 is located at a fixed position by the fastening lock 24 of the handrail frame 20.

What is claimed is:

1. A jogging machine comprising:

a base rested on the ground and provided with two guide slots symmetrical to each other; wherein said base has two parallel base rods;

a jogging platform;

an urging frame having a main support rod, an auxiliary support rod parallel to said main support rod, two side support rods connecting said main support rod and said auxiliary support rods, an input member mounted on said main support rod, and two rollers mounted on two ends of said auxiliary support rod, said urging frame being pivotally mounted on said jogging platform at said main support rod, said two rollers being slidably disposed in said guide slots to slide therein back and forth;

a linear actuator disposed on said jogging platform and connected with said input member to actuate said input member to pivot said urging frame on the jogging platform; and two pull rods which are respectively pivoted at first ends thereof with an inner wall of a rear segment of said two parallel base rods and at second ends thereof with said main support rod, each of said pull rods being provided with a caster located in proximity of the point at which said pull rods are respectively pivoted to said base rods.

2. The jogging machine as defined in claim 1, wherein said two guide slots are disposed in an inner wall of the front segment of said two parallel base rods.

3. The jogging machine as defined in claim 1, further comprising a handrail frame which has two support rods parallel to each other and being disposed on the top of the front segment of said two base rods of said base, said handrail frame further having a cross rod connecting said two support rods, two hand grips disposed on the top ends of said two support rods, and a fastening lock disposed on one of said support rods.

4. The jogging machine as defined in claim 1, wherein said jogging platform has a base frame which has two side rods parallel to each other, two rollers disposed between said two side rods, a jogging belt running through said two rollers, and a drive device having an electric motor for driving said two rollers.

5. The jogging machine as defined in claim 4, wherein said main support rod of said urging frame is pivoted at both ends thereof with a pivoting seat of the underside of said side support rods of said jogging platform, thereby enabling said urging frame to pivot on an axis of said main support rod.

6. The jogging machine as defined in claim 1, wherein said linear actuator includes a motor, and a speed changing output member which has a transmission shaft and a driven member fitted over said output shaft, said transmission shaft being a guide threaded rod, said driven member being a threaded sleeve, said driven member capable of moving along an axial direction of said transmission shaft when said transmission shaft turns, said linear actuator being mounted pivotally on said urging member by pivoted engagement of said driven member to said input member of said urging frame.

* * * * *